US007512996B2

(12) United States Patent
Yoo et al.

(10) Patent No.: US 7,512,996 B2
(45) Date of Patent: Apr. 7, 2009

(54) PROTECTIVE KNEE COVERING

(75) Inventors: Herbert Ki Yoo, Beaverton, OR (US); Christopher J. Nascimento, Beaverton, OR (US); Chris S. Page, Portland, OR (US)

(73) Assignee: Nike, Inc., Beaverton, OR (US)

( * ) Notice: Subject to any disclaimer, the term of this patent is extended or adjusted under 35 U.S.C. 154(b) by 36 days.

(21) Appl. No.: 11/669,231

(22) Filed: Jan. 31, 2007

(65) Prior Publication Data

US 2008/0178361 A1 Jul. 31, 2008

(51) Int. Cl.
*A41D 13/00* (2006.01)
*A41D 13/06* (2006.01)
*A41D 27/12* (2006.01)

(52) U.S. Cl. ..... 2/455; 2/2.5; 2/22; 2/24; 2/268

(58) Field of Classification Search ..... 2/455, 2/2.5, 22–24, 267, 911
See application file for complete search history.

(56) References Cited

U.S. PATENT DOCUMENTS 4,953,913 A * 9/1990 Graebe ..... 297/452.25
5,147,685 A * 9/1992 Hanson ..... 428/189
5,405,312 A * 4/1995 Jacobs ..... 602/5
5,452,475 A * 9/1995 Hunt, Jr. ..... 2/22
5,477,559 A * 12/1995 Clement ..... 2/22
5,592,706 A * 1/1997 Pearce ..... 5/654
5,652,956 A * 8/1997 Hoshizaki et al. ..... 2/22
5,662,594 A * 9/1997 Rosenblatt ..... 602/16
5,732,411 A * 3/1998 Coleman et al. ..... 2/22
5,794,261 A * 8/1998 Hefling ..... 2/16
5,829,055 A * 11/1998 Collins et al. ..... 2/22
5,840,397 A * 11/1998 Landi et al. ..... 428/73
5,966,739 A * 10/1999 Wagner ..... 2/23
6,122,768 A * 9/2000 McCrane ..... 2/16
6,128,779 A * 10/2000 Goldsmith et al. ..... 2/22
6,178,556 B1 * 1/2001 Foreman et al. ..... 2/22
6,272,682 B1 * 8/2001 Fullum ..... 2/22
6,317,888 B1 * 11/2001 McFarlane ..... 2/24
6,336,220 B1 * 1/2002 Sacks et al. ..... 2/22
D461,936 S * 8/2002 Fiorini et al. ..... D29/122
6,654,961 B2 * 12/2003 Beland ..... 2/22
6,789,264 B2 * 9/2004 Budda ..... 2/22
6,804,832 B2 * 10/2004 Beland ..... 2/227
7,013,487 B2 * 3/2006 Beland ..... 2/22

(Continued)

OTHER PUBLICATIONS

U.S. Appl. No. 11/669,224, filed Jan. 31, 2007.

*Primary Examiner*—Bobby H Muromoto, Jr.
(74) *Attorney, Agent, or Firm*—Plumsea Law Group, LLC

(57) ABSTRACT

A protective knee covering which provides motion guidance and orthotic support for a knee. The protective knee covering is made from a layer of rigid material, such as a plastic or a composite material. A central portion of the protective knee covering covers the knee cap portion of the knee. The central portion is curved in a top to bottom direction, but is flat or substantially flat in a medial side to lateral side direction to provide a stable base for kneeling. A medial side portion and a lateral side portion are attached to the central portion at angles. The lateral side portion is attached at a sharper angle than the medial side portion. Both of these portions cover the sides of the knee. The lateral side portion acts as an orthotic guide during bending of the knee to keep the thigh over the knee.

14 Claims, 5 Drawing Sheets

U.S. PATENT DOCUMENTS

D518,922 S * 4/2006 Beland ..... D29/122
7,047,566 B2 * 5/2006 Beland et al. ..... 2/22
D554,806 S * 11/2007 Le Carpentier ..... D29/120.1
2003/0019006 A1 1/2003 Godshaw et al.
2005/0246812 A1 * 11/2005 Bevier ..... 2/22
2005/0252119 A1 * 11/2005 Funk-Danielson ..... 52/245
2007/0124843 A1 * 6/2007 Bevier ..... 2/22

* cited by examiner

PROTECTIVE KNEE COVERING

BACKGROUND OF THE INVENTION

1. Field of the Invention

The present invention relates generally to sporting equipment. More particularly, the present invention relates to a knee covering of a leg guard for a baseball or a softball catcher.

2. Description of Related Art

In baseball and softball, the catcher, positioned behind home plate with a view of the entire playing field, performs many vital functions during a game, from calling plays and protecting the plate to receiving the ball from the pitcher. As home plate crashes with other players and impacts from pitches in excess of 90 mph are common in baseball, the bodies of catchers are physically punished regularly during a game.

Due in part to the awkward crouching position catchers assume behind home plate, catchers commonly injure their knees. A catcher's blocking motions for stopping wild, tipped, or dropped pitches require that the catcher first drop rapidly onto their knees from the crouch, and just as rapidly either reassume the crouch or stand upright to throw out any potential base stealers. Further, throughout a game, a catcher will typically receive a pitch in the crouch, then kneel or stand upright to throw the ball back to the pitcher. Repeating this motion, especially kneeling, hundreds of times or more per gameday can severely fatigue a catcher's knees and thighs.

Since the early days of baseball, catchers have been provided with equipment to protect their bodies from these various stresses. As the lower legs are particularly vulnerable, various design for leg guards have been produced to allow the catcher maximum freedom of movement while still providing protection against impacts from balls or players. As a result, most leg guards employ a series of rigid padded plates which are strapped onto the leg.

Some protective knee coverings have been developed to cushion the knee while kneeling. For example, U.S. patent publication No. 2003/0019006 to Godshaw et al. describes a knee pad which includes a rigid outer shell and an insert fitted inside the shell to protect and cushion a user's knee, such as while kneeling to install flooring. The insert is either asymmetric or strategically placed in the shell so as to accommodate either the left or right knee of the wearer. This construction is designed to provide maximum support and cushioning to the oppositely-shaped left and right knees. However, the shell of this construction is symmetrical, and no additional stabilization is provided for the knee as the catcher moves his or her knees during a game.

Therefore, there exists a need in the art for a protective knee covering for a baseball or softball catcher which helps to stabilize the catcher's knee throughout the game while supporting the knee and allowing a catcher to freely maneuver from the couching to the blocking position or standing position.

SUMMARY OF THE INVENTION

In one aspect, the invention provides a protective covering for a knee comprising a rigid layer having a central portion sized and dimension to cover a knee cap portion of the knee. The central portion is substantially flat in a medial side to a lateral side direction. A lateral portion is attached to a lateral side of the central portion at an angle. The lateral portion is sized and dimensioned to cover at least a portion of a lateral side of the knee. A medial portion is attached to a medial side of the central portion at a radius of curvature, the medial portion being sized and dimensioned to cover at least a portion of a medial side of the knee.

In another aspect, the central portion has a curvature in a top edge to bottom edge direction In another aspect, the rigid layer is made from a plastic material.

In another aspect, the rigid layer is made from a composite material.

In another aspect, the rigid layer has a substantially uniform thickness.

In another aspect, the rigid layer is connected to a cushioning layer.

In another aspect, the lateral portion is sized and dimensioned to cover all or substantially all of the lateral side of the knee.

In another aspect, the medial portion is sized and dimensioned to cover all or substantially all of the medial side of the knee.

In another aspect, the angle being about 90 degrees or less.

In another aspect, the angle being between about 45 degrees and about 75 degrees.

In another aspect, the angle being about 60 degrees.

In another aspect, the protective covering is integrated into a leg guard for a baseball or softball catcher.

In another aspect, the invention provides an orthotic covering for a knee comprising a central portion sized and dimensioned to cover a knee cap portion of a knee. A lateral portion is attached to the central portion at an angle and sized and dimensioned so that the rigid portion extends over at least a portion of a lateral side of the knee. The lateral portion maintains alignment of the knee while the knee is bent or is bending. The orthotic covering being made from a rigid material.

In another aspect, the central portion has no or substantially no curvature in a medial side to lateral side direction.

In another aspect, the central portion has a curvature in a top to bottom direction.

In another aspect, the protective covering also includes a medial portion attached to the central portion at a radius of curvature and sized and dimensioned so that the medial portion extends over at least a portion of a medial side of the knee.

In another aspect, the rigid material is a plastic material.

In another aspect, the rigid material is a composite material.

In another aspect, the orthotic covering is attached to a cushioning layer.

In another aspect, the orthotic covering is integrated into a leg guard for a baseball or softball catcher.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

To receive a ball from a pitcher during a baseball or softball game, the catcher generally crouches behind home plate. As the ball is generally thrown by professionals at speeds exceeding 90 mph, a catcher wears protective equipment to protect the catcher from impacts by the ball. The protective equipment also protects the catcher from collisions with other players, such as base runners attempting to score at home plate. As the positions assumed by the catcher place strain on the knee, the present invention provides a protective knee covering that orthotically assists in stabilizing and guiding the motion of the knee at the catcher assumes and transitions from one position to another.

Figure 1:
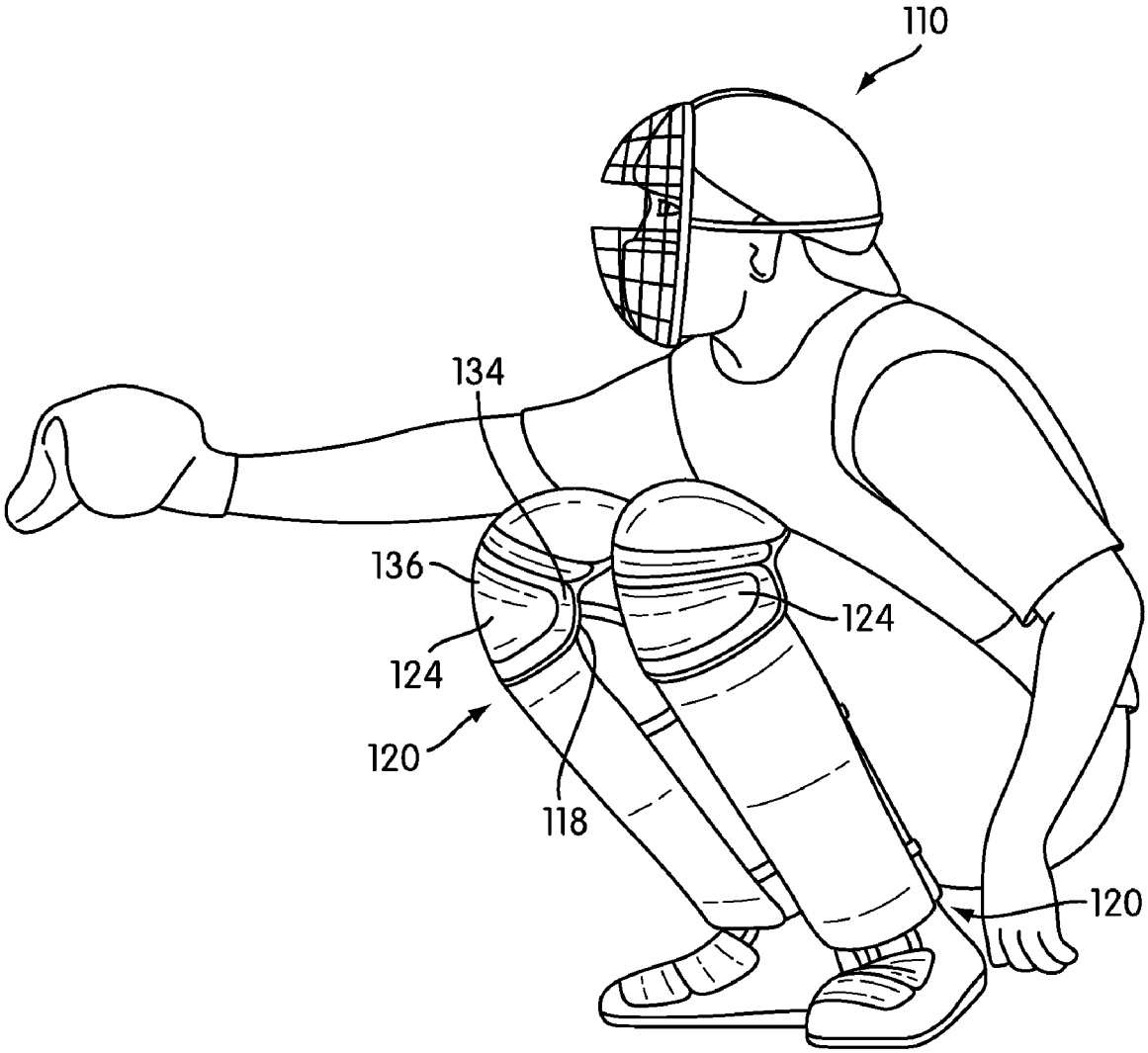
FIG. 1 is a schematic drawing of a baseball catcher wearing a leg guard having a protective knee covering.
Figure 2:
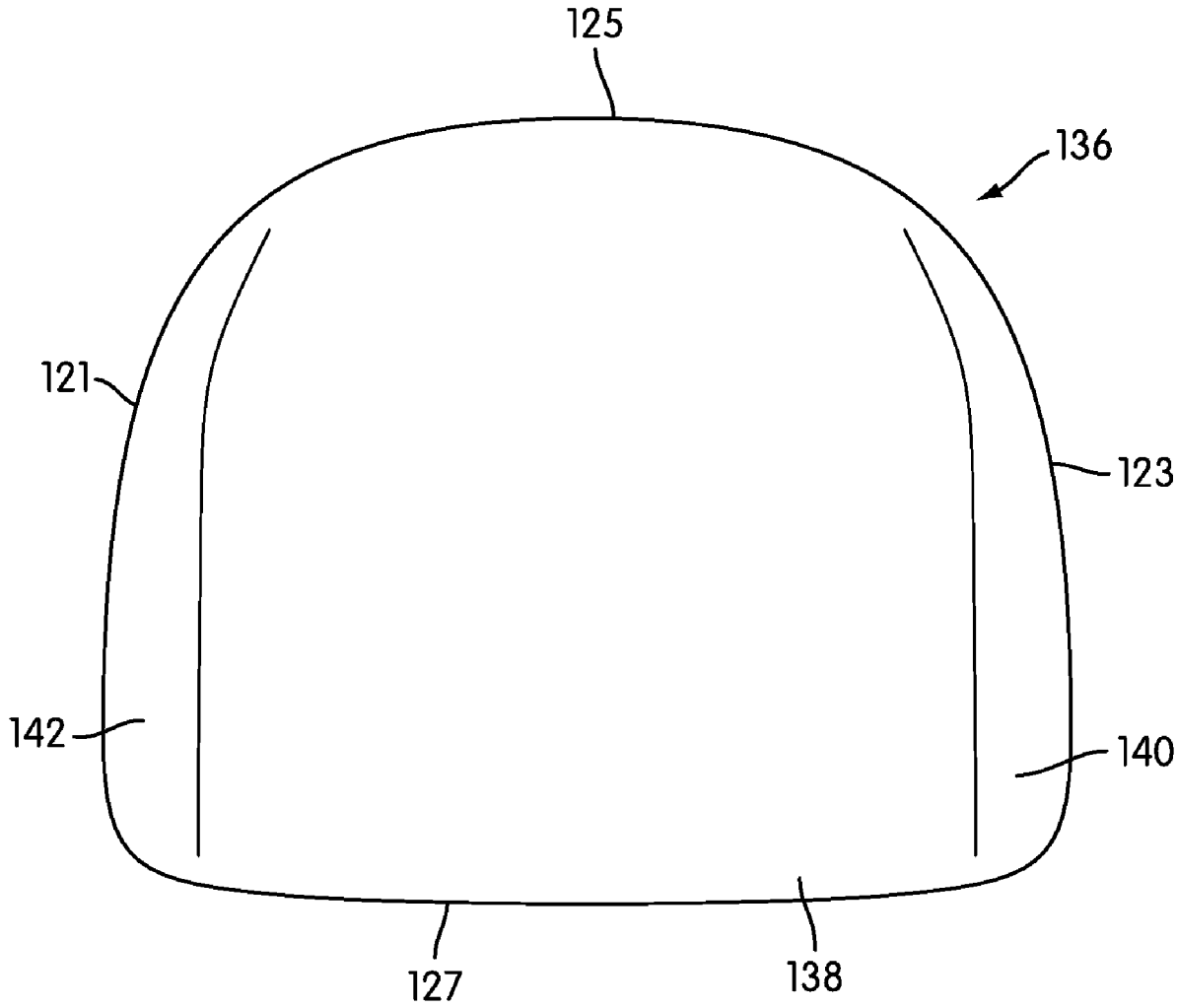
FIG. 2 is a schematic front view of a protective knee covering according to the invention.
Figure 3:
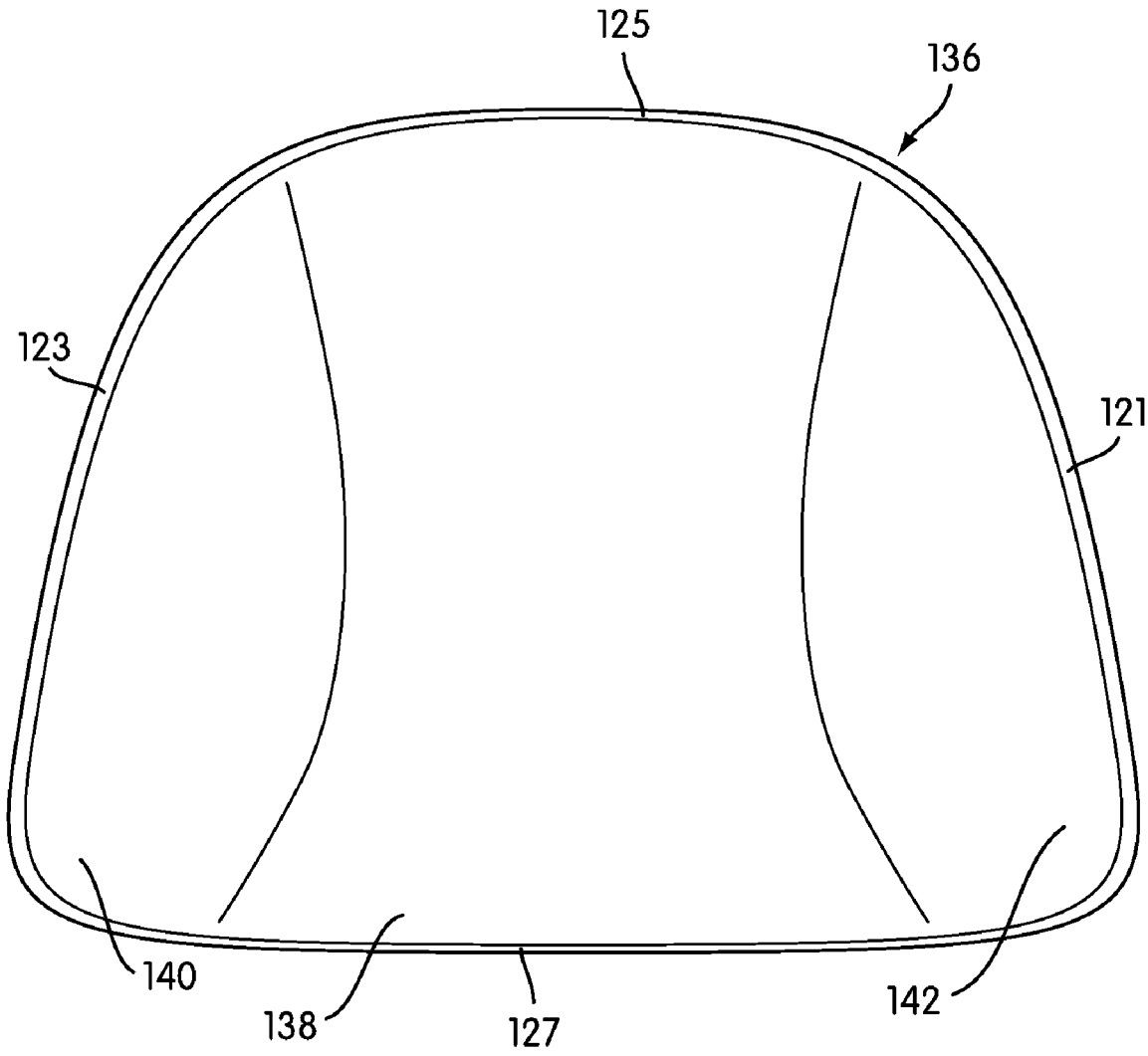
FIG. 3 is a schematic rear view of a protective knee covering according to the invention.
Figure 4:
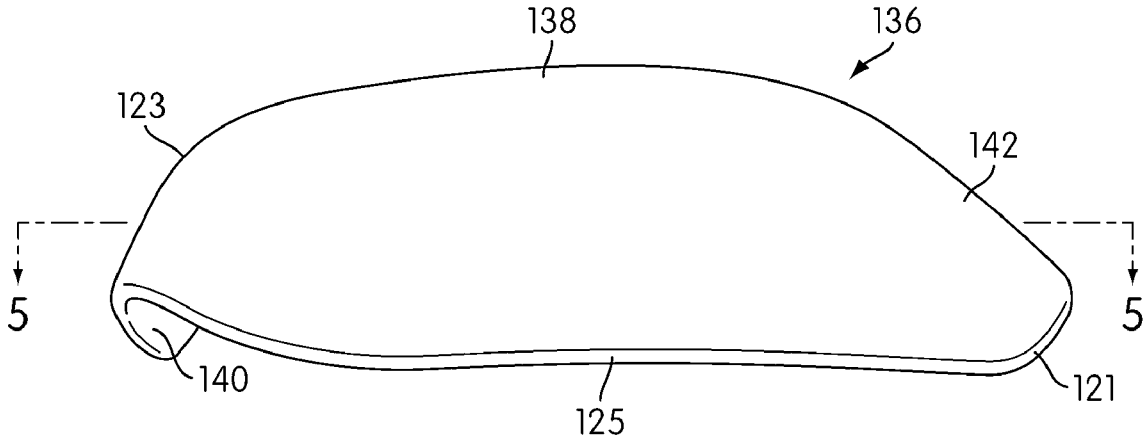
FIG. 4 is a schematic top view of a protective knee covering according to the invention.

FIG. 1 is a schematic view of a catcher 110 wearing an exemplary embodiment of protective leg guards 120. Each leg guard 120 includes a protective knee covering 124 which substantially covers a knee 118 of catcher 110. Preferably, as shown in FIG. 1, protective knee covering 124 is connected to additional protective coverings, such as thigh coverings and shin coverings. However, in other embodiments, protective knee covering 124 may be used as a separate or singular covering. An example of a leg guard which may incorporate a protective knee covering according to the present invention is disclosed in U.S. patent application Ser. No. 11/669,224, entitled "Leg Guard" and filed on even date herewith, which patent application is incorporated herein by reference.

As a joint, knee 118 includes a number of different degrees of motion which allow the shin to move with respect to the thigh. Such movements include, for example, a simple hinge-like bend to fold the shin under the thigh, a rotating motion in which the shin twists so that the toes point to lateral side 123 or medial side 121, also called pronation, and combinations of these motions, for example to hold the thigh stable while swinging the foot in a circle. While moving knee 118 in a particular way, for example a simple bend, the muscles and ligaments of the joint work to prevent knee 118 from moving in another way, for example, pronating. Furthermore, as an athlete performs during a game, the muscles around knee 118 tire from use, as conventional knee coverings include a rounded surface on which the catcher must balance while kneeling. As a result, the athlete may struggle to prevent knee 118 from moving in multiple degrees of freedom when only one degree of freedom is desired and also must use the muscles of both legs to maintain balance on the rounded surface of the conventional knee covering.

Figure 5:
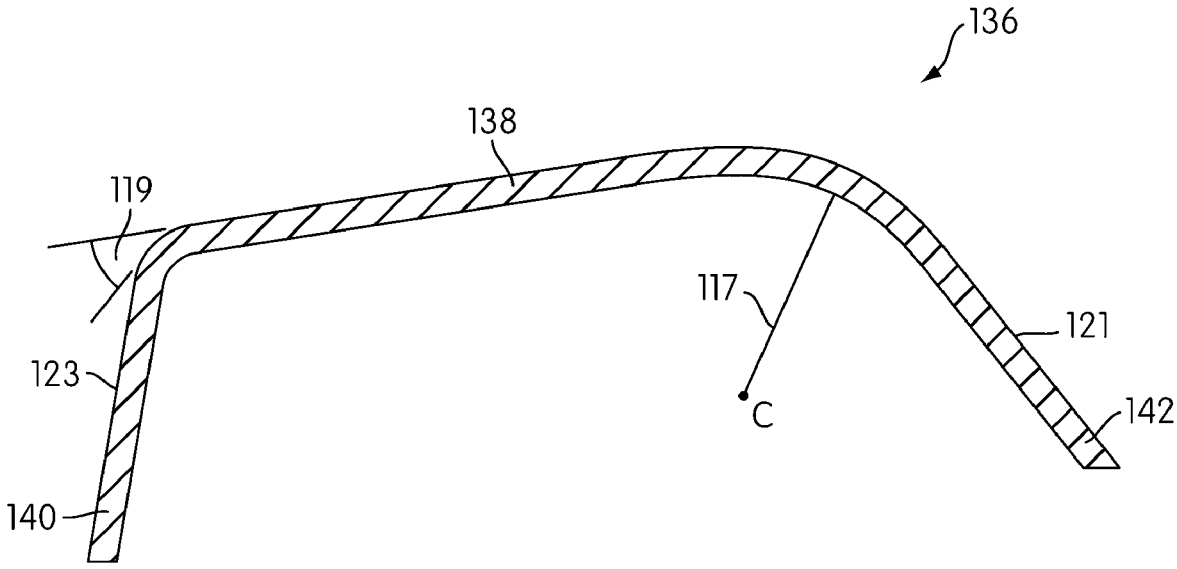
FIG. 5 is a schematic cross-sectional view of the protective knee covering shown in FIG. 4, taken along line 5-5.

As shown in FIGS. 2-5, a rigid plate 136 is configured to provide the orthotic support of knee 118. Rigid plate 136 generally includes a flat or substantially flat central portion 138 which contacts the ground when the catcher is kneeling. This flat surface allows the catcher to balance more easily while kneeling, as flat central portion 138 provides a relatively large stable surface area in contact with the ground. A conventional knee covering requires that a catcher balance on the much smaller contact point provided by a curved surface. Further, the flat surface of central portion 138 resists rocking, while a curved surface promotes rocking, thereby requiring a catcher to constantly adjust and correct his or her balance. As is best shown in FIG. 5, a cross-sectional view of rigid plate 136, central portion 138 has no or very little curvature on the medial side 121 to lateral side 123 direction. Central portion 138 may have little or no curvature in a top 125 to bottom 127 direction, but preferably has a curvature in a top 125 to bottom 127 direction to accommodate knee 118 when knee 118 is bent and to assist the catcher in moving from a kneeling position to a standing position. The catcher may easily shift position from a weight-forward stance on his or her knees while kneeling to a weight-backward stance on his or her feet by rocking on the top-to-bottom curvature of central portion 138.

On medial side 121 of central portion 138, a medial portion 142 of rigid plate 136 curves away from central portion 138. As shown in FIG. 5, medial portion 142 is connected to central portion 138 at a radius of curvature 117, emanating from an imaginary center point C. Preferably, radius of curvature 117 is sufficiently large that medial portion 142 is angled at least slightly away from a lateral portion 140, although in other embodiments, radius of curvature 117 may be smaller. The length of medial portion 142 is preferably sufficiently long to cover the medial side 121 of knee 118. However, in other embodiments, medial portion 142 may be shorter so that only a portion of the medial side of knee 118 is covered.

On lateral side 123 of central portion 138, lateral portion 140 or outrigger extends away from central portion 138 to form a angle 119. Angle 119 is preferably acute, so that lateral portion 140 extends at least slightly away from medial portion 142. Preferably, radius of curvature is about 60 degrees. In another embodiment, angle 119 is about 90 degrees or less. In another embodiment, angle 119 is between about 45 degrees and 75 degrees. Preferably, the length of lateral portion 140 is sufficiently long to cover or substantially cover a lateral side of knee 118. However, in other embodiments, lateral portion 140 only covers a portion of the lateral side of knee 118.

To provide sufficient orthotic support and guidance, rigid plate 136 is preferably made from a stiff, durable material, such as plastic or a composite material like fiberglass or carbon reinforced epoxy. Rigid plate 136 is preferably manufactured by injection molding, though plate 136 may, in other embodiments, be made by any other type of manufacturing technique known in the art. Rigid plate 136 is preferably uniform in thickness, although in other embodiments, the thickness may vary, such as by having a thicker medial portion 142 than lateral portion 140.

As shown in FIG. 1, rigid plate 136 is preferably attached to a pad 134 made of a cushioning material. Pad 134 is preferably a cushioning panel made of any material known in the art, such as foam, natural or synthetic batting, or similar materials. Additionally, combinations of materials may be used, such as providing a foam or memory foam wrapped or covered in a wicking material for additional comfort while wearing protective covering 124 for long periods of time in hot weather. Pad 134 may be fixedly or removably attached to rigid plate 136. For example, pad 134 may be attached to rigid plate 136 removably, such as with hook-and-loop closures such as Velcro®, snaps, clips, or the like. Preferably, however, pad 134 is fixedly attached to rigid plate 136 by any method known in the art, such as with an adhesive, rivets, stitches or the like. Additionally, protective knee covering 124 is preferably removably attached to a leg, such as with a strapping system, for example the strapping system described in the co-pending '224 application, previously incorporated by reference.

Rigid plate 136 acts as an orthotic device to guide and align the movement of knee 118 in two ways: 1) by discouraging knee 118 to rock in a medial side 121 to a lateral side 123 direction while promoting movement in a top 125 to bottom 127 direction when knee 118 is planted on the ground, and 2) by resisting pronation of the knee 118 as knee 118 is bent or while knee 118 is bending. The configuration of rigid plate 136 orthotically guides the motion of knee 118. For example, central portion 138 is flat in a side-to-side direction but curved in a top-to-bottom direction. Therefore, rigid plate 136 encourages rocking in the top-to-bottom direction, but rocking side-to-side is inhibited. The side-to-side rocking is further inhibited by the relatively sharp angles of rigid plate 136 where central portion 138 transitions to medial portion 142 and lateral portion 140.

As shown in FIG. 1, catcher 110 assumes a crouch position to receive a pitch. In this position, the catcher's feet are firmly planted on the ground, while knees 118 are bent and splayed apart. Many defensive moves made by the catcher originate from this stance.

Figure 6:
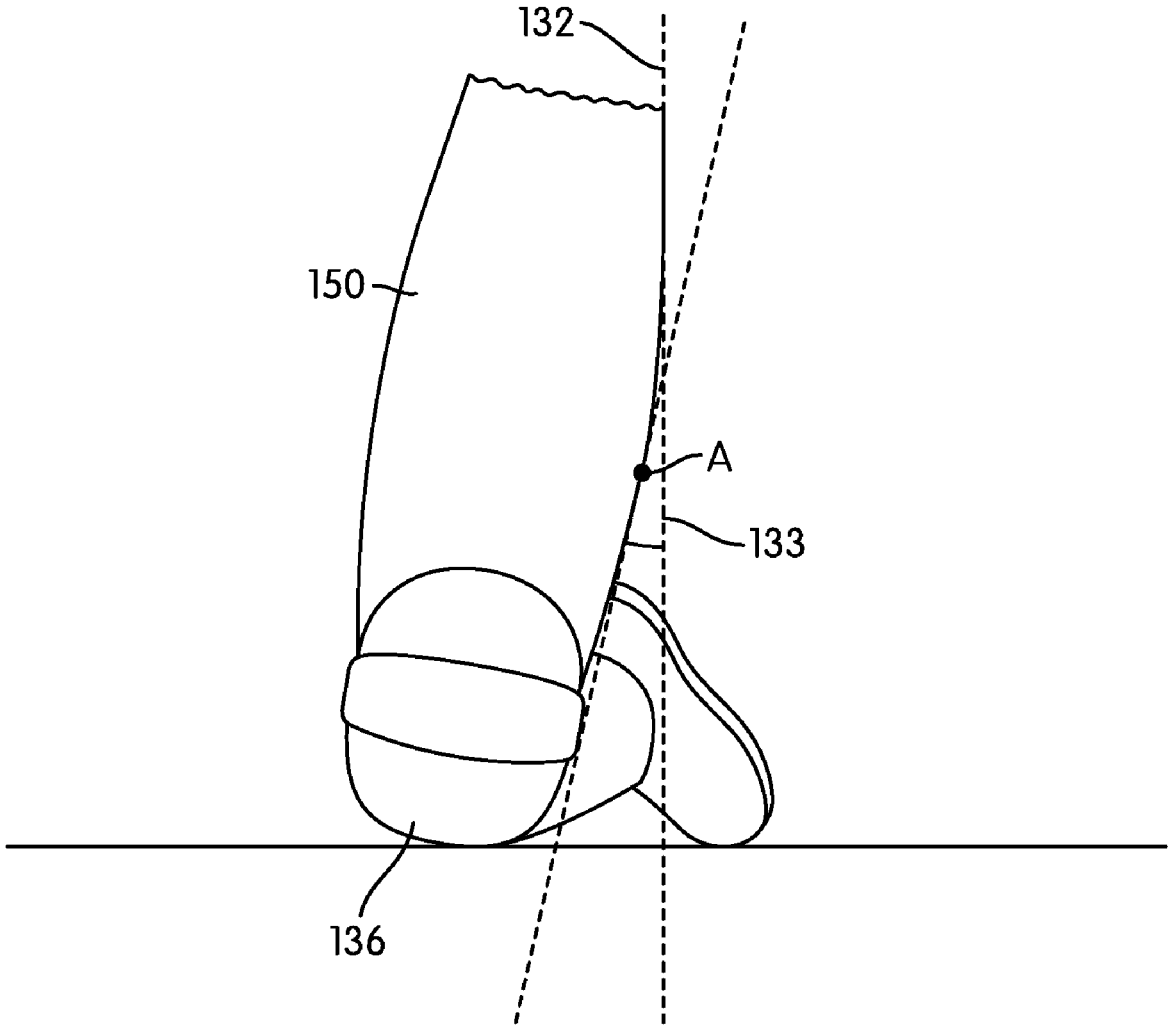
FIG. 6 is a schematic view of the catcher's leg after the catcher throws the ball.

After fielding a pitch, the catcher may throw the ball back to the pitcher while on one or both knees. FIG. 6 shows this position, where the catcher typically places substantially all of his or her weight on one knee and straightens. To reach this position, the knee is rolled laterally, so that preferably only central portion 138 (shown in FIGS. 2-5) contacts ground surface 131. In this position, tangent line 132 forms a sharp angle 139 with a line 133 normal to ground surface 131. Typically sharp angle 139 is between about 10 degrees and about 15 degrees. Over the course of a game, catchers fatigue their thigh muscles when assuming this position, as the thigh muscles of the leg maintain the alignment of the knee when moving into this position. The knee may be damaged if the knee is rolled too far laterally or if the knee pronates during movement. Central portion 138 is substantially flat in a side-to-side direction, so the knee is inhibited from rolling too far laterally, because additional force is required to roll the knee laterally from the flat central portion over the relatively sharp curve where rigid plate 136 transitions to lateral portion 140. In this position, because of the top-to-bottom curvature of the knee rocks relatively easily in the top-to-bottom direction. This assists the catcher in rocking back onto his or her feet to stand or to re-assume the crouch position.

Further, lateral portion 140 provides an orthotic guide to assure proper alignment of the knee. Lateral portion 140 provides support for the knee, so that the muscles of the thigh do not have to tense as much to prevent misalignment of the knee. In other words, lateral portion 140 helps to brace the knee and prevent unintentional pronation. Additionally, lateral portion 140 helps to keep the thigh over the knee while the knee is bent or bending. As the flesh of the knee encounters the rigid material of lateral portion 140, the knee presses against lateral portion 140. The rigid material of lateral portion 140 acts as a brace would, resisting movement in the lateral direction while allowing movement in others. This assists in the force transfer from the legs when throwing the ball while kneeling. As lateral portion 140 covers or substantially covers the lateral side of the knee, no part of the knee may roll or splay laterally. This increases the stability of the knee, thereby helping to prevent muscle fatigue and injury.

It will be appreciated that protective covering 136 may be used in industries other than baseball and softball, especially when used as an orthotic device. For example, in construction, workers often have to squat or kneel the move to an upright or standing position. When moving through these positions, protective covering 136, working in the manner described above, may assist the worker in transitioning from one position to another while maintaining proper alignment of the knee. This may help to avoid long-term repetitive injuries to the knees.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A protective covering for a knee having a medial side on an inside of the leg, a lateral side on an outside of the leg, a top edge proximate a thigh, and a bottom edge proximate a shin, the protective covering comprising:

a rigid orthotic layer having a central portion configured to be positioned over a knee cap portion of the knee, wherein the rigid layer is asymmetric;

the central portion being substantially flat in a medial side to a lateral side direction;

a lateral portion extending away from a lateral side of the central portion at an acute angle;

the lateral portion extending over a lateral side of the knee;

a medial portion that curves away from a medial side of the central portion at an obtuse angle;

the medial portion extending over a medial side of the knee; and the lateral portion is a brace configured to prevent pronation of the knee in a lateral direction by resisting lateral movement of the knee while the medial portion is configured to allow a full range of motion.

2. The protective covering of claim 1, the central portion having a curvature in a top edge to bottom edge direction.

3. The protective covering of claim 1, the rigid orthotic layer being made from a plastic material.

4. The protective covering of claim 1, the rigid orthotic layer being made from a composite material.

5. The protective covering of claim 1, the rigid orthotic layer having a substantially uniform thickness.

6. The protective covering of claim 1, the rigid orthotic layer connected to a cushioning layer, wherein the rigid orthotic layer is positioned on the protective covering to be in direct contact with a ground surface and the cushioning layer is positioned on the protective covering to be in direct contact with a wearer when the wearer is kneeling.

7. The protective covering of claim 1, the acute angle being between about 45 degrees and about 75 degrees.

8. The protective covering of claim 1, the acute angle being about 60 degrees.

9. The protective covering of claim 1 integrated into a leg guard for a baseball or softball catcher.

10. A protective knee covering for a knee having a medial side on an inside of the leg, a lateral side on an outside of the leg, a top edge proximate a thigh, and a bottom edge proximate a shin, the protective covering comprising:

an orthotic having a central portion configured to be positioned over a knee cap portion of the knee, wherein the orthotic is asymmetric so that a lateral side of the orthotic has a different shape than a medial side of the orthotic;

the central portion being substantially flat in a medial-to-lateral side direction to inhibit the ability of a wearer to rock the protective covering in the medial-to-lateral side direction;

the central portion having a curvature in a top-to-bottom direction to enhance the ability of the wearer to rock the protective covering in the top-to-bottom direction;

a lateral portion extending away from a lateral side of the central portion at a fixed acute angle, wherein the acute angle ranges from about 45 degrees to about 75 degrees;

the lateral portion extending over a lateral side of the knee and wherein the lateral portion is coextensive with the central portion in a top-to-bottom direction at the point where the lateral portion meets the central portion;

a medial portion that curves away from a medial side of the central portion at an obtuse angle;

the medial portion extending over a medial side of the knee; and wherein the orthotic is formed from a material having sufficient rigidity to prevent lateral pronation of the knee.

11. The protective knee covering of claim 10, the material being a plastic.

12. The protective knee covering of claim 10, the material being a composite material.

13. The protective knee covering of claim 10, the orthotic being attached to a cushioning layer.

14. The protective knee covering of claim 10, the orthotic integrated into a leg guard for a baseball or softball catcher.

* * * * *